US007090087B1

(12) United States Patent
Guralski

(10) Patent No.: US 7,090,087 B1
(45) Date of Patent: Aug. 15, 2006

(54) APPARATUS FOR HOLDING AN INVERTED CONTAINER

(76) Inventor: Daniel M. Guralski, 4029 Hickory Hills Rd., Reedsville, WI (US) 54230

( * ) Notice: Subject to any disclaimer, the term of this patent is extended or adjusted under 35 U.S.C. 154(b) by 295 days.

(21) Appl. No.: 10/458,990

(22) Filed: Jun. 12, 2003

(51) Int. Cl.
*A47G 23/02* (2006.01)
*A47K 1/08* (2006.01)

(52) U.S. Cl. ..... 215/395; 215/386; 215/393; 220/737; 211/74; 248/311.2; 248/311.3

(58) Field of Classification Search ..... 215/393, 215/395, 399, 386; 220/773, 926, 737; 248/311.2, 248/311.3, 311, 346.11; 211/74
See application file for complete search history.

(56) References Cited

U.S. PATENT DOCUMENTS

| | | | | | |
|---|---|---|---|---|---|
| 358,688 | A | * | 3/1887 | Nassauer | 248/154 |
| 703,902 | A | * | 7/1902 | Ludin | 200/3 |
| 1,060,048 | A | * | 4/1913 | Wetzel | 141/88 |
| 1,159,491 | A | * | 11/1915 | Graham | 220/737 |
| 1,171,210 | A | * | 2/1916 | Keffer | 248/152 |
| 1,351,007 | A | * | 8/1920 | Shephard | 248/524 |
| 2,189,587 | A | * | 2/1940 | Lallement | 220/737 |
| 2,215,411 | A | * | 9/1940 | Sebring | 248/311.2 |
| 2,639,039 | A | * | 5/1953 | Daniels | 211/85.4 |
| 2,910,219 | A | * | 10/1959 | Bennett et al. | 220/737 |
| 2,936,144 | A | * | 5/1960 | Otis | 248/150 |
| 3,181,701 | A | * | 5/1965 | Cole | 211/74 |
| 4,271,878 | A | | 6/1981 | Bologa | |
| 4,638,595 | A | * | 1/1987 | Rivero | 47/39 |
| 4,678,149 | A | * | 7/1987 | Chase | 248/150 |
| 4,948,080 | A | * | 8/1990 | Jack | 248/311.2 |
| 4,969,618 | A | * | 11/1990 | Thompson | 248/152 |
| D318,393 | S | | 7/1991 | Shea et al. | |
| 5,149,032 | A | * | 9/1992 | Jones et al. | 248/154 |
| 5,154,380 | A | * | 10/1992 | Risca | 248/154 |
| 5,282,592 | A | * | 2/1994 | Ma | 248/150 |
| 5,398,898 | A | * | 3/1995 | Bever | 248/154 |
| 5,533,700 | A | * | 7/1996 | Porter | 248/311.2 |
| 5,560,578 | A | * | 10/1996 | Schenken et al. | 248/313 |
| 5,687,874 | A | * | 11/1997 | Omori et al. | 220/737 |
| 6,039,206 | A | * | 3/2000 | DeFrancesco | 220/737 |
| 6,054,326 | A | * | 4/2000 | Dubus | 436/180 |
| 6,109,581 | A | | 8/2000 | Kracke et al. | |
| D445,683 | S | * | 7/2001 | Michael et al. | D9/443 |
| 6,375,134 | B1 | * | 4/2002 | Goldschmidt et al. | 248/154 |
| 6,684,922 | B1 | * | 2/2004 | Alston et al. | 141/375 |

* cited by examiner

*Primary Examiner*—Sue A. Weaver
(74) *Attorney, Agent, or Firm*—Brannen Law Office, LLC

(57) ABSTRACT

The present invention has a radius rectangular base with a platform lying in a base plane. Four slots are through, the base in a generally rectangular configuration around the perimeter of the base. Four members are provided, one for being removeably inserted into each slot. The members preferably snap fit into the base, and have lengths that upstand from the base. Each member has a wall lying in a respective plane. The members are resiliently deflectable throughout their respective lengths that upstand from the base. Each side member deflects so that the top of a container received within the present invention rests on the surface of the base. The side members engage the body of the container to keep it in an inverted and vertical orientation. The center of gravity of the container is kept as low as possible in this regard.

7 Claims, 8 Drawing Sheets

APPARATUS FOR HOLDING AN INVERTED CONTAINER

BACKGROUND OF THE INVENTION

1. Field of the Invention

The present invention relates to an apparatus for holding an inverted container, and more particularly to an apparatus that holds an inverted container in a vertical orientation as the container rests on the surface of a base.

2. Description of the Related Art

There exists many undesirable aspects associated with the contents of a container settling to the bottom of the container. Examples of two notable and very common containers are ketchup and mustard containers. These containers can be made of either plastic or glass. These types of containers 10 have a central axis 11. The containers 10 have a top 12 and a bottom 13. A neck 14 is often near the top 12, and a body 15 is between the neck 14 and bottom 13. The contents of the container 10 usually exit the container 10 though an opening at the top 12 of the container 10. One problem associated with these types of containers 10 is that as the contents settle, water sometimes separates from the contents. In order to remove the contents from the container 10, the user inverts the container and the contents are either squeezed out or fall out due to the force of gravity. In either case any water that has separated from the remainder of the contents is first to exit the container 10, which is undesirable.

One way to avoid this problem is to shake up the contents of the container 10 before attempting to extract the contents. However, this practice is undesirable as it may not be socially acceptable to shake the container at a given location, such as certain types of restaurants. Also, there exists a risk that the container 10 could slip out of a person's hands while the person is shaking it. The container 10 could then inadvertently strike nearby persons or objects. Further, if the container 10 is made of glass, it could shatter if it strikes a hard object after slipping out of a person's hands.

Another problem associated with these types of containers 10 is that it can be difficult to extract all of the contents from the container. Shaking the container 10 may help alleviate this problem. However, as noted above, shaking the container 10 can be undesirable. Further, this method may not be fully effective at removing contents from the container 10.

One way people try to overcome these problems is to store the containers in an inverted manner. One common practice is to delicately store the container 10 in an inverted manner in a refrigerator. The refrigerator has a door with shelves. The person puts the container 10 on a shelf in a corner and propped against the door. Yet, the container 10 often falls over when a person opens or closes the door. Even when the container is successfully stored in an inverted manner in a refrigerator, the benefits of this storage practice are quickly lost when the container 10 is placed upright on a surface 31 of a serving area 30, as the contents will tend to again settle to the bottom of the container.

United States Patent Number Design 318,393 to Shea et al. shows a bottle holder. However, there is no teaching or suggestions contained in this patent that the bottle holder could be used to hold a bottle in an inverted manner. Even if the bottle holder shown in this patent could hold a bottle in an inverted manner, it would yield undesirable results. A typical bottle has a body and a neck, wherein the neck is narrower than the body. When inverted, the narrower neck is below the wider body. Yet, this patent shows a bottle holder that is relatively narrow near its top and relatively wide near its base. Hence, this bottle holder appears incompatible for use with typical bottles. Also, the sides are arcuate shaped, which inhibits deflection of the sides. There is no indication that a bottle held by the bottle holder shown in this patent is fully received within the bottle holder. This is undesirable because the center of gravity of the combination of a bottle held by the bottle holder and the bottle holder may be undesirably high if the bottle does not rest on the base of the bottle holder.

U.S. Pat. No. 4,271,878 to Bologa shows a liquid transfer device. This patent shows a holder that receives the neck of a bottle. The center of gravity of the combination of the liquid transfer device and bottle is undesirably high. Therefore, if a bottle were stored in this device, it would be at an increased risk of falling or being unintentionally knocked over.

U.S. Pat. No. 6,109,581 to Kracke et al. shows an inverted container holder. A cylindrical piece is shown for receiving an inverted container. However, in order to effectively work, the cylindrical piece must be sized for a particular container. Containers that are too narrow may topple within the holder. Containers that are too wide will not fit within the holder. Therefore, the user must have several different sized holders on hand to meet the needs of a particular container. Further, a cylindrical holder is only designed for a cylindrical container. Yet, many containers are not cylindrical in shape. This patent does not show deflectable sides that can receive bottles of various sized and shapes.

Thus there exists a need for an apparatus for holding an inverted container that solves these and other problems.

SUMMARY OF THE INVENTION

The present invention relates to an apparatus used to hold a container in an inverted manner. The inverted container holder of the present invention comprises a base with surface and several members are upstanding from the base.

In accordance with the present invention, the inverted container holder has a base. The base has platform lying in a plane with a surface. The base can have a radius rectangular shape. In one embodiment of the present invention, the base has four slots therethrough. The slots are oriented in a generally rectangular manner around the perimeter of the base.

A member is provided for being inserted into each slot. Each member has a wall lying in a plane. A snap fitting assembly can be at the bottom of each member, wherein a bottom wedge is provided for being removeably inserted though each corresponding slot, and a two top wedges are provided for engaging the surface of the platform. Removing the members from the base minimizes shipping and storage volumes, and also facilitates thorough cleaning of the present invention.

According to another aspect of the present invention, the members are resiliently deflectable throughout their respective lengths that upstand from the base. Each side member deflects so that the top 12 of a container 10 is received within the present invention and rests on the surface of the base. The side members engage the body 15 of the container to keep it in an inverted and vertical orientation. The center of gravity of the container 10 is kept as low as possible by resting the top 12 of the container on the surface of the base. This minimizes the risk that the container 12 could be inadvertently knocked or tipped over.

The present invention is storable anywhere in a refrigerator eliminating the need to prop a container in the corner of a shelf, or against another object. Furthers the present invention can also be placed on the surface 31 of a serving area 30. Hence the benefits of storing the container in an inverted orientation are maintained until a person selectively removes the container 10 from the inverted container holder of the present invention.

In accordance with another aspect of the present invention, the members can be clear to allow the user to quickly determine the amount of contents in the container 10. Also, the members can have grips thereon to facilitate moving the present invention.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
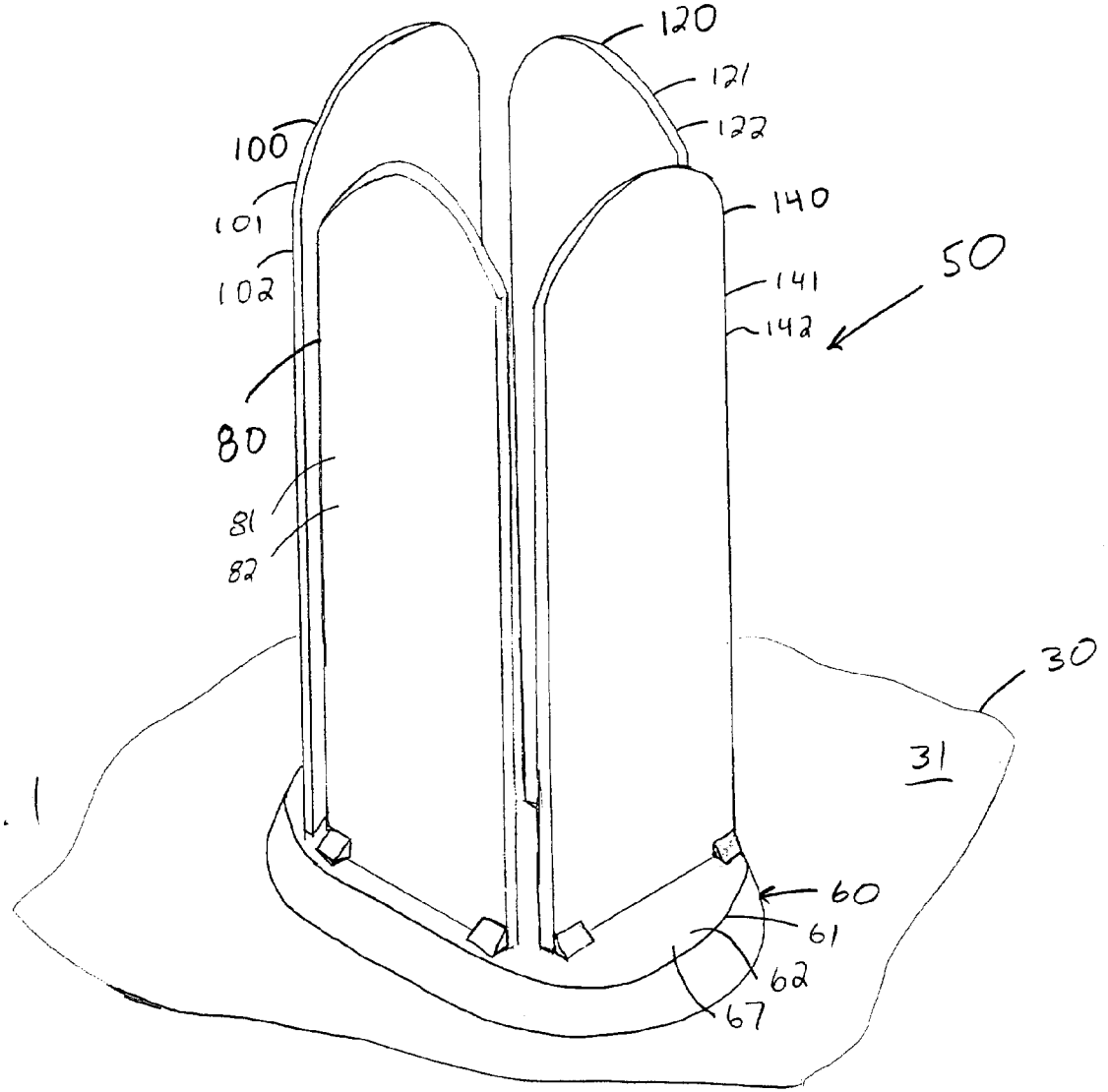
FIG. 1 is a perspective view of the present invention.

While the invention will be described in connection with a preferred embodiment, it will be understood that it is not intended to limit the invention to that embodiment. In the contrary, it is intended to cover all alternatives, modifications and equivalents as may be included within the spirit and scope of the invention as defined by the appended claims.

The present invention relates to and comprises an inverted container holder 50. In the preferred embodiment, the inverted container holder 50 is made of polycarbonate. However, other resilient materials can be used without departing from the broad aspects of the present invention. Examples of other types of resilient materials include plastic, wood and metal. The present invention is preferably generally transparent, or clear. However, it can be translucent or opaque without departing from the broad aspects of the present invention. It is preferred that the components of the present invention be made in an injection molding process. However, other manufacturing processes can be used without departing from the broad aspects of the present invention.

The inverted container holder 50 of the present invention comprises a base 60, as shown in FIGS. 1–6, and 10. The base 60 preferably has a platform 61 with a surface 62. The base 60 has a first side 63, a second side 64, a third side 65 and a fourth side 66. However, more sides (not shown) can be provided without departing from the broad aspects of the present invention. The first side 63 is opposed to the third side 65, and the second side 64 is opposed to the fourth side 66. The base 60 is preferably generally radius rectangular in shape. The base 60 can have other shapes without departing from the broad aspect of the present invention. For example, the base could alternatively be generally square, rectangular, ovular or circular. In the preferred embodiment, the base 60 measures approximately 2½ inches between the first side 63 and third side 65, and approximately 3¾ inches between the second side 64 and fourth side 66. The base 60 has a height of approximately ⅜ inches. The platform 61 lies in a plane 67.

Figure 5:
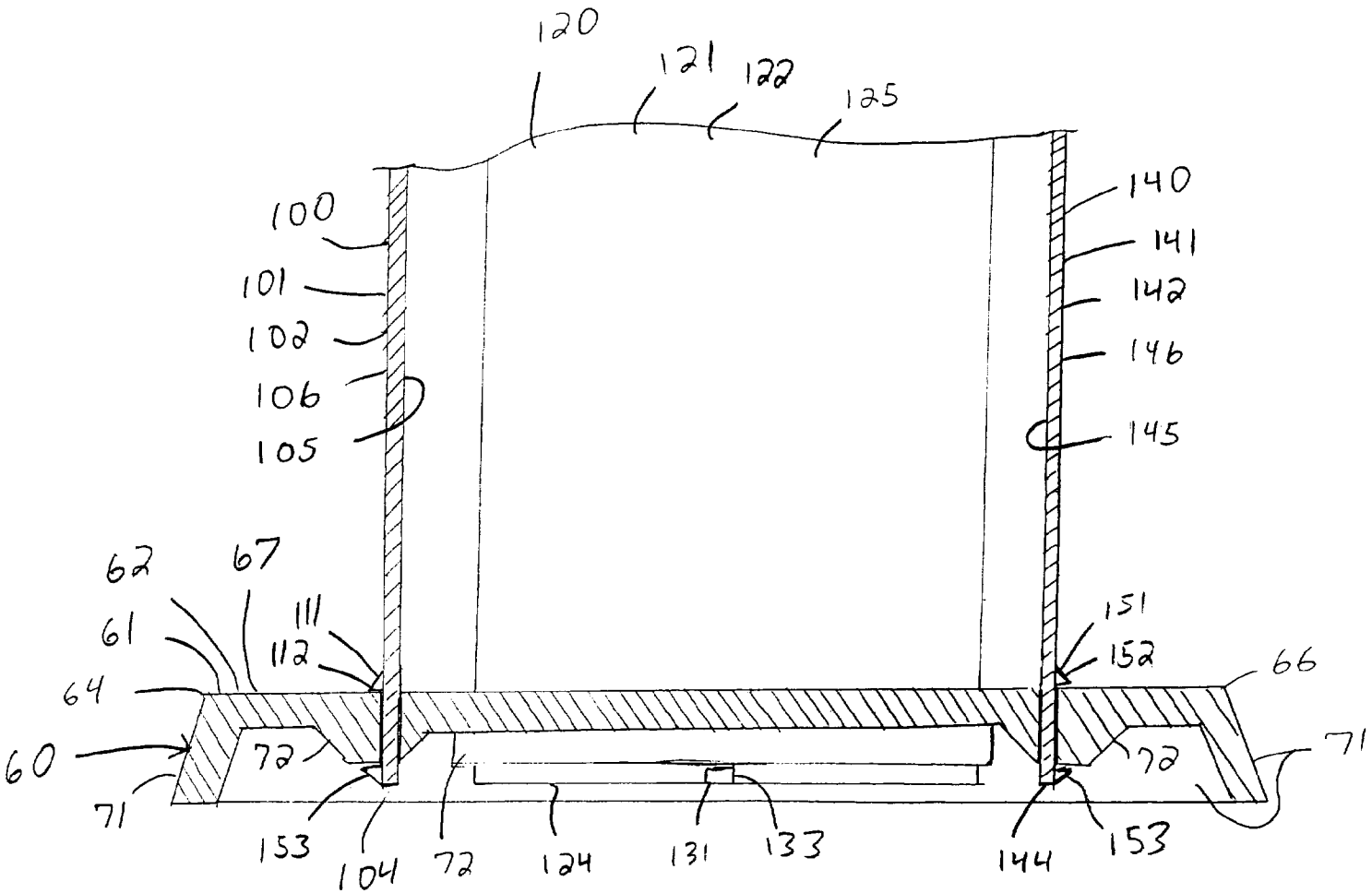
FIG. 5 is a cross-sectional view of the present invention taken along line 5—5 in FIG. 4.
Figure 6:
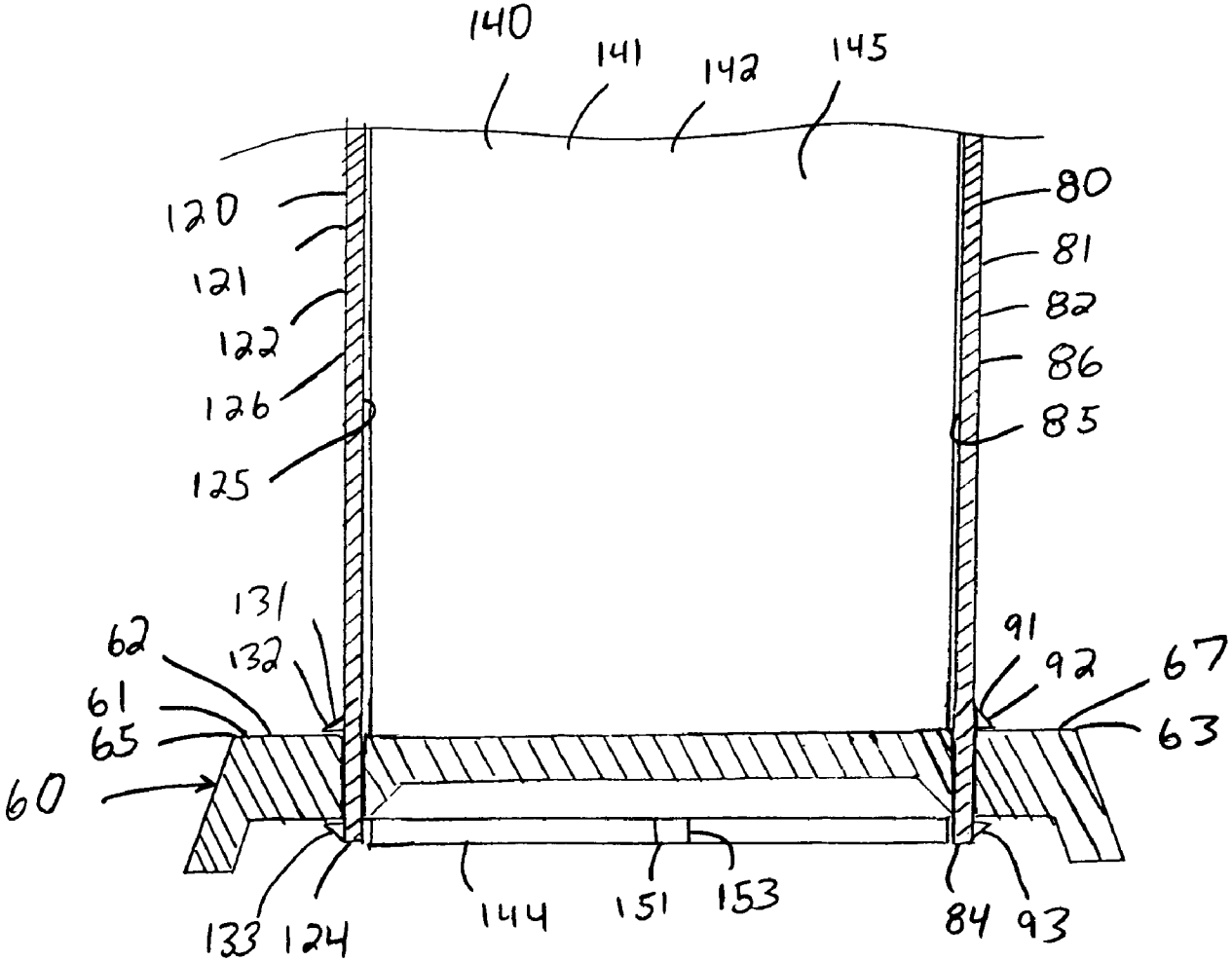
FIG. 6 is a cross-sectional view of the present invention taken along line 6—6 in FIG. 4.

A rail 71 is provided around the perimeter of the base 60, as best shown in FIGS. 5 and 6. The rail 71 is connected to and located below the platform 61. The rail 71 is preferably tapered. Alternatively, the rail can be vertical, rounded, or otherwise shaped without departing from the broad aspects of the present invention. Bracing 72 is provided and connected to the rail 71 and underside of the platform 61. The bracing 72 is preferably only provided near the perimeter of the base 60. The bracing 72 can be connected to the rail 71, as is shown in FIG. 5. Alternatively, the bracing 72 can be near the rail 71, but not connected to it, as shown in FIG. 6.

The platform 60, rail 71 and bracing 72 are preferably made integral with each other in an injection molding process. However, they could be formed independently and later connected to each other with a fastener such as an adhesive, or with a sonic weld or a solvent weld.

Figure 4:
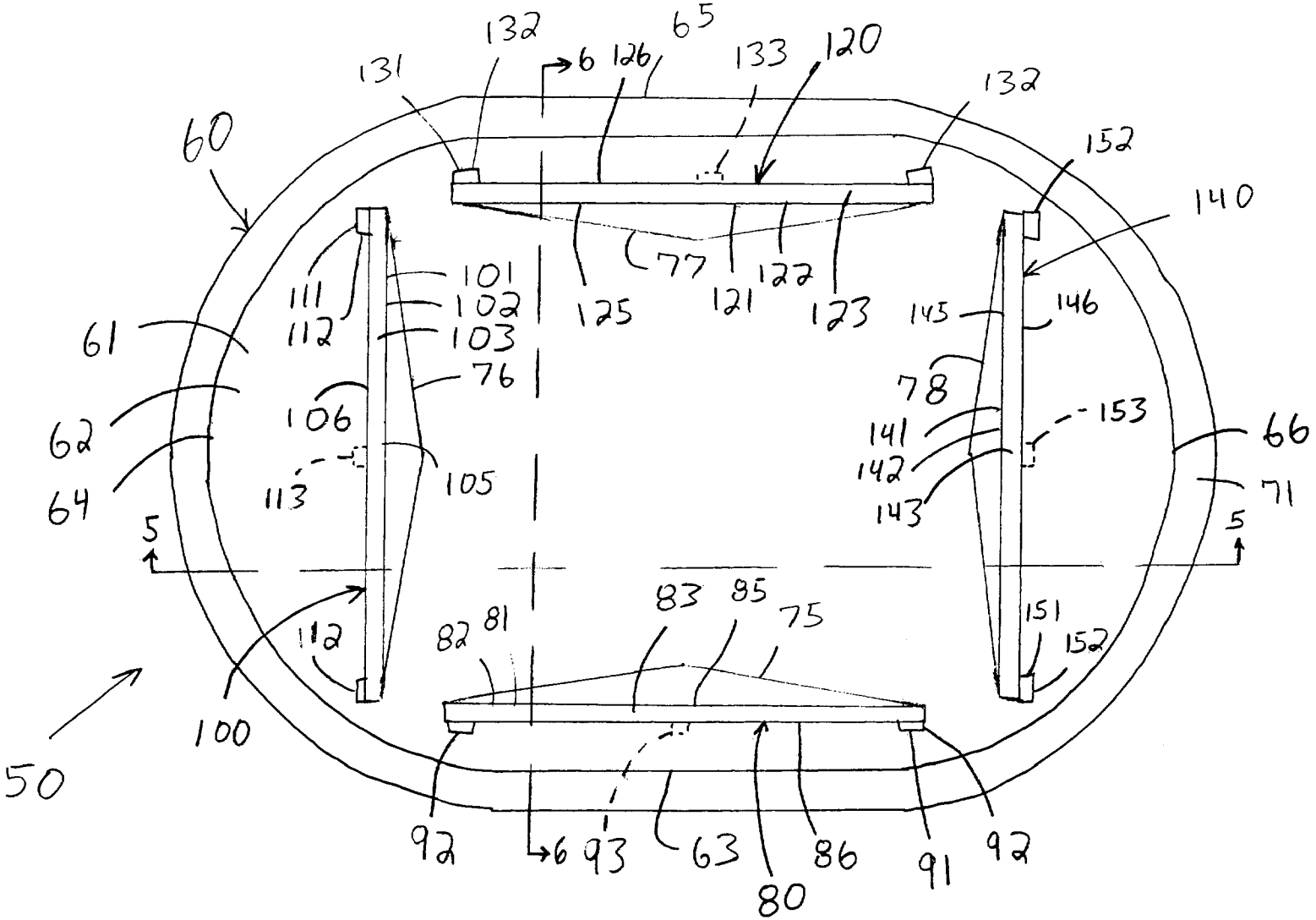
FIG. 4 is a top view of the present invention.

A first slot 75 is provided near the first side 63, as shown in FIG. 4. The first slot extends through the platform 61 and corresponding bracing 72. The slot is generally triangularly shaped. The long leg of the triangle is near the first side 63. The two remaining sides are generally equal in length, and converge at a point away from the first side 63. Slot 75 could alternatively be shaped differently, such as rounded or ovular, without departing from the broad aspects of the present invention.

A second slot 76, a third slot 77 and a fourth slot 78 are also provided, as shown in FIG. 4. Those slots 76, 77 and 78 are located near the second side 64, third side 65 and fourth side 66 of the platform 61, respectively. The slots 76, 77 and 78 extend through the platform 61 and corresponding bracing 72, and are similarly shaped to slot 75. As with slot 75, slots 76, 77 and 78 could alternatively be shaped differently, such as rounded or ovular, without departing from the broad aspects of the present invention.

According to another aspect of the present invention, a first member 80, or side panel, is provided, as shown in FIGS. 1–4, and 6. The first member 80 is preferably about 1¾ inches wide, 5½ inches tall and 1/16 inch thick. The first member 80 comprises a wall 81, which generally lies in a plane 82 when undeflected. The first member is preferably resiliently deflectable out of plane 82. The first member 80 has a top 83 and a bottom 84, a first side 85 and a second side 86. A grip 87 is preferably located on the second side 86 of the wall 81, near its top 83. Grip 87 can be used to lift the present invention 50. The grip 87 can be generally circular in shape, and can have a diameter of approximately 1¾ inches. However, other shapes and sizes can be used without departing from the broad aspects of the present invention. One preferred grip is textured and formed integral with the side during the injection molding process. The textured grip can have multiple depressions or ridges. Alternatively, the grip could be a separate component adhesively affixed to the first member 80.

A snap fitting assembly 91, best shown in FIG. 6, is on the first member 80, and particularly to its second side 86 neat its bottom 84. The snap fitting assembly 91 has two top wedges 92 and one bottom wedge 93. The top wedges 92 are preferably spaced apart, and the bottom wedge 93 is located intermediate between the top wedges 92. The top wedges 92 and bottom wedge 93 are preferably formed integral with the wall 81. However, the wedges 92 and 93 could alternatively be connected to the wall 81 with an adhesive, a solvent weld or a sonic weld.

A second member 100, or side panel, is provided, as shown in FIGS. 1–5. The second member 100 is preferably about 1¾ inches wide, 5½ inches tall and 1/16 inch thick. The second member 100 comprises a wall 101, which generally lies in a plane 102 when undeflected. The second member 100 is preferably resiliently deflectable out of plane 102. The second member 100 has a top 103 and a bottom 104, a first side 105 and a second side 106. An optional grip (not shown) can be located on the second side 106 of the wall 101, near its top 103.

A snap fitting assembly 111 is on the second member 100, and particularly to its second side 106 near its bottom 104, as shown in FIG. 5. The snap fitting assembly 111 has two top wedges 112 and one bottom wedge 113. The top wedges 112 are preferably spaced apart, and the bottom wedge 113 is located intermediate between the top wedges 112. The top wedges 112 and bottom wedge 113 are preferably formed integral with the wall 101. However, the wedges 112 and 113 could alternatively be connected to the wall 101 with an adhesive, a solvent weld or a sonic weld.

A third member 120, or side panel, is also provided, as shown in FIGS. 1, 4, 6, and 7–9. The third member 120 is preferably about 1¾ inches wide, 5½ inches tall and 1/16 inch thick. The third member 120 comprises a wall 121, which generally lies in a plane 122 when undeflected. The third member 120 is preferably resiliently deflectable out of plane 122. The first member 120 has a top 123 and a bottom 124, a first side 125 and a second side 126. A grip 127 is preferably located on the second side 126 of the wall 121, neat its top 123. Grip 127 can be used to lift the present invention 50. The grip 127 can be generally circular in shape, and can have a diameter of approximately 1¾ inches. However, other shapes and sizes can be used without departing from the broad aspects of the present invention. One preferred grip is textured and formed integral with the side during the injection molding process. The textured grip can have multiple depressions or ridges. Alternatively, the grip could be a separate component adhesively affixed to the third member 12.

Figure 7:
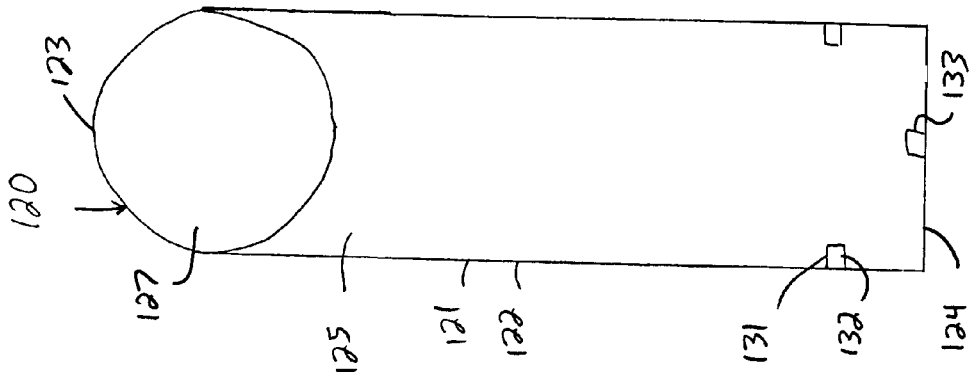
FIG. 7 is a first side view of a side member comprising a grip.
Figure 8:
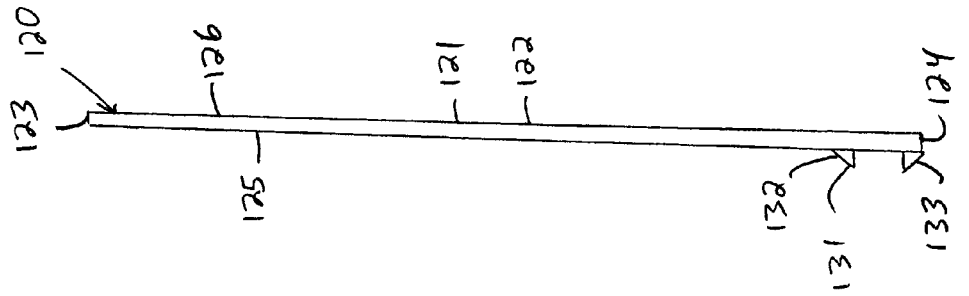
FIG. 8 is an end view of the side member shown in FIG. 7.
Figure 9:
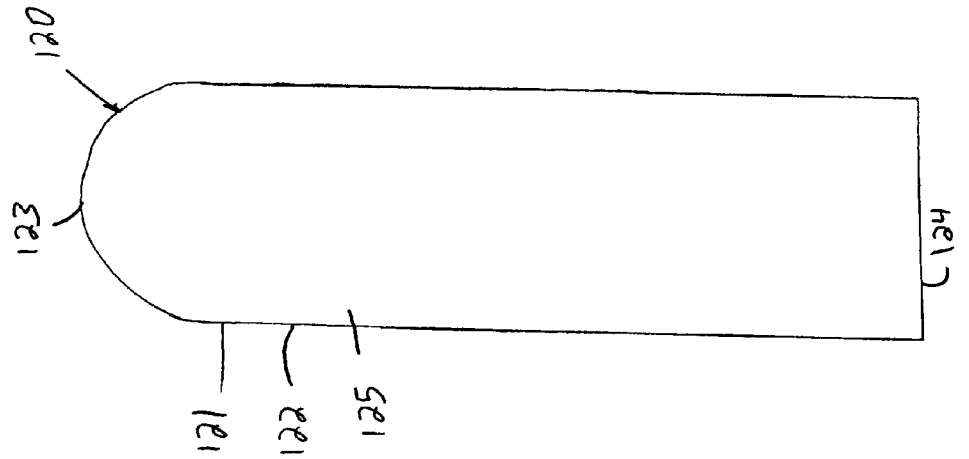
FIG. 9 is a second side view of the side member shown in FIG. 7.

A snap fitting assembly 131 is on the third member 120, and particularly to its second side 126 near its bottom 124, as best shown in FIGS. 6–8. The snap fitting assembly 131 has two top wedges 132 and one bottom wedge 133. The top wedges 132 are preferably spaced apart, and the bottom wedge 133 is located intermediate between the top wedges 132. The top wedges 132 and bottom wedge 133 are preferably formed integral with the wall 121. However, the wedges 132 and 133 could alternatively be connected to the wall 121 with an adhesive, a solvent weld or a sonic weld.

A fourth member 140, or side panel, is also provided, as shown in FIGS. 1–5. The fourth member 140 is preferably about 1¾ inches wide, 5½ inches tall and 1/16 inch thick. The fourth member 140 comprises a wall 141, which generally lies in a plane 142 when undeflected. The first member 140 is preferably resiliently deflectable out of plane 142. The first member 140 has a top 143 and a bottom 144, a first side 145 and a second side 146. An optional grip (not shown) can be located on the second side 146 of the wall 141, near its top 143.

A snap fitting assembly 151 is on the fourth member 140, and particularly to its second side 146 near its bottom 144, as best shown in FIG. 5. The snap fitting assembly 151 has two top wedges 152 and one bottom wedge 153. The top wedges 152 are preferably spaced apart, and the bottom wedge 153 is located intermediate between the top wedges 152. The top wedges 152 and bottom wedge 153 are preferably formed integral with the wall 141. However, the wedges 152 and 153 could alternatively be connected to the wall 141 with an adhesive, a solvent weld or a sonic weld.

The present invention 50 could comprise fewer or more members or side panels without departing from the broad aspects of the present invention. Further, the side members are shown to be generally rectangular in shape with a rounded top end. However, the side members could alternatively be differently shaped without departing from the broad aspects of the present invention. For example, the side members could alternatively be square or triangular without departing from the broad aspects of the present invention.

Each member 80, 100, 120 and 140 has a snap fitting assembly 91, 111, 131 and 151, respectively. The side members 80, 100, 120 and 140 are removeably insertable into slots 75, 76, 77 and 78, respectively using the snap fit method of assembly and disassembly described below. However, other methods of assembly could be used without departing from the broad aspects of the present invention. Further, when using some alternative methods of assembly, disassembly may not be possible. Examples of alternative methods of assembly could include the using an adhesive, using a solvent weld or a sonic weld. Also, rivets or screws could be used.

The first member 80 is removeably insertable through the first slot 75. In particular, the bottom wedge 93 of the snap fitting assembly 91 is insertable through the first slot 75. As shown in FIG. 6, when assembled, the bottom wedge 93 engages the bracing 72 under the platform 61 near the first side 63 of the base 60. The top wedges 92 engage the surface 62 of the platform 61, and are not insertable through the base 60. The top wedges 92 and bottom wedge 93 are spaced apart so that when the bottom wedge 93 engages the bracing 72, the top wedges 92 snugly engage the surface 62 of the platform 61. In an embodiment (not shown) where no bracing is provided, the bottom wedge can engage the underside of the platform 61 and the top wedges engage the surface 62 of the platform 61. When the first member 80 is inserted through the base 60, the plane 82 containing the undeflected wall 81 is generally perpendicular to the platform plane 67.

The second member 100 is removeably insertable though the second slot 76. In particular, the bottom wedge 113 of the snap fitting assembly 111 is insertable through the second slot 76. As shown in FIG. 5, when assembled, the bottom wedge 113 engages the bracing 72 under the platform 61 near the second side 64 of the base 60. The top wedges 112 engage the surface 62 of the platform 61, and are not insertable through the base 60. The top wedges 112 and bottom wedge 113 are spaced apart so that when the bottom wedge 113 engages the bracing 72, the top wedges 112 snugly engage the surface 62 of the platform 61. In an embodiment (not shown) where no bracing is provided, the bottom wedge can engage the underside of the platform 61 and the top wedges engage the surface 62 of the platform 61. When the second member 100 is inserted through the base 60, the plane 102 containing the undeflected wall 101 is generally perpendicular to the platform plane 67.

The third member 120 is removeably insertable through the third slot 77. In particular, the bottom wedge 133 of the snap fitting assembly 131 is insertable through the third slot 77. As shown in FIG. 6, when assembled, the bottom wedge 133 engages the bracing 72 under the platform 61 near the third side 65 of the base 60. The top wedges 132 engage the surface 62 of the platform 61 and are not insertable through the base 60. The top wedges 132 and bottom wedge 133 are spaced apart so that when the bottom wedge 133 engages the bracing 72, the top wedges 132 snugly engage the surface 62 of the platform. In an embodiment (not shown) where no bracing is provided, the bottom wedge can engage the underside of the platform 61 and the top wedge engages the surface 62 of the platform 61. When the third member 120 is inserted through the base 60, the plane 122 containing the undeflected wall 121 is generally perpendicular to the platform plane 67.

The fourth member 140 is removeably insertable through the fourth slot 78. In particular, the bottom wedge 153 of the snap fitting assembly 151 is insertable through the fourth slot 78. As shown in FIG. 5, when assembled, the bottom wedge 153 engages the bracing 72 under the platform 61 near the fourth side 66 of the base 60. The top wedges 152 engage the surface 62 of the platform 61, and are not insertable through the base 60. The top wedges 152 and bottom wedge 153 are spaced apart so that when the bottom wedge 153 engages the bracing 72, the top wedges 152 snugly engage the surface 62 of the platform. In an embodiment (not shown) where no bracing is provided, the bottom wedge can engage the underside of the platform 61 and the top wedge engages the surface 62 of the platform 61. When the fourth member 140 is inserted through the base 60, the plane 142 containing the undeflected wall 141 is generally perpendicular to the platform plane 67.

Figure 10:
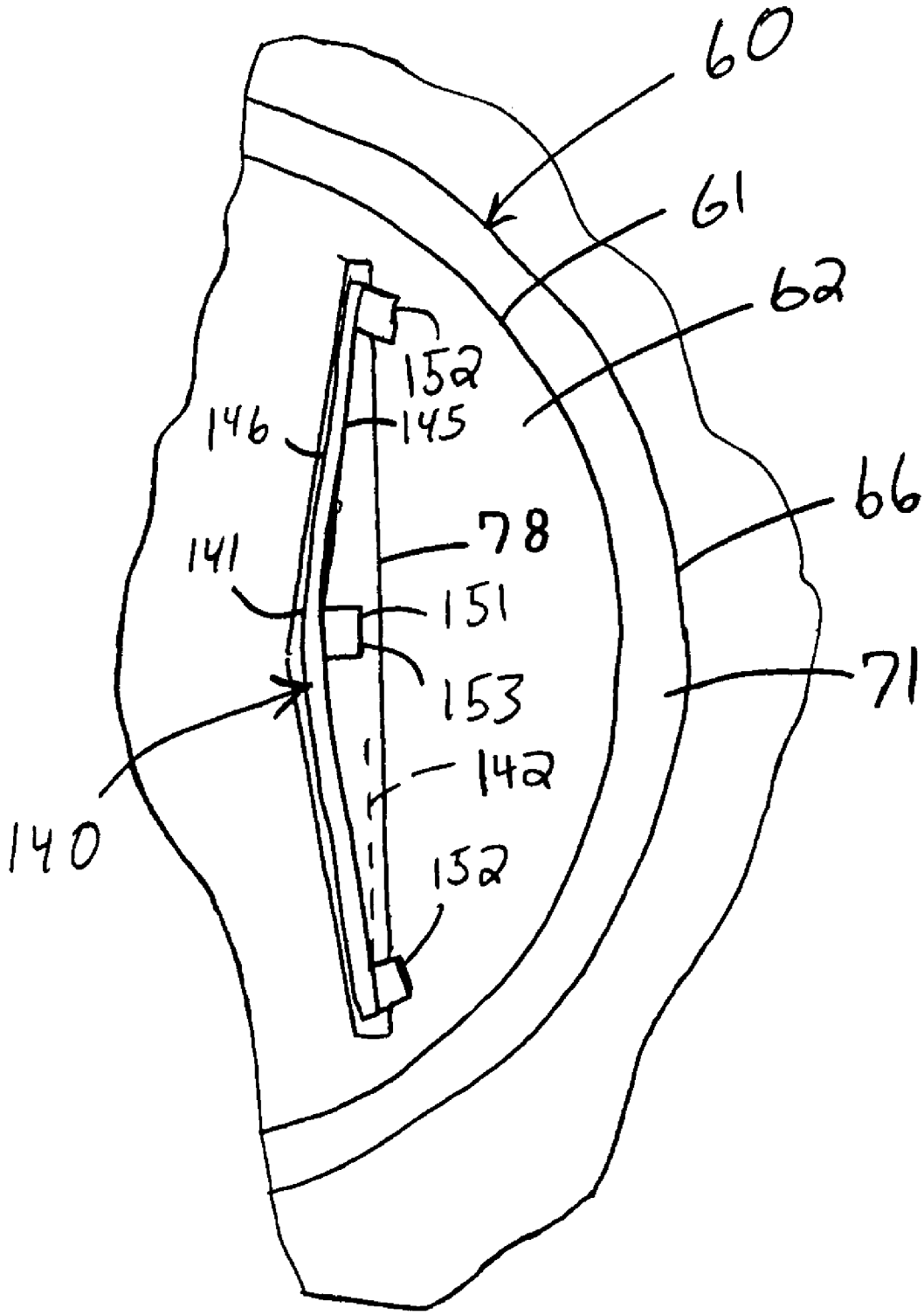
FIG. 10 is a top view of a side member in twisted orientation ready to be removed from the base.

Each of the members 80, 100, 120 and 140 are removeable from the base 60 in a similar manner. Therefore, only removal of member 140 is illustrated in the figures. The removal of member 140 from the base 60 is shown in FIG. 10. To remove the fourth member 140 from the base 60, member 140 is first deflected within the slot 78. Then, the member 140 is removed from the base. As shown in FIG. 10, the bottom wedge 153 clears the platform 61 when the side member 140 is deflected in this manner.

Figure 2:
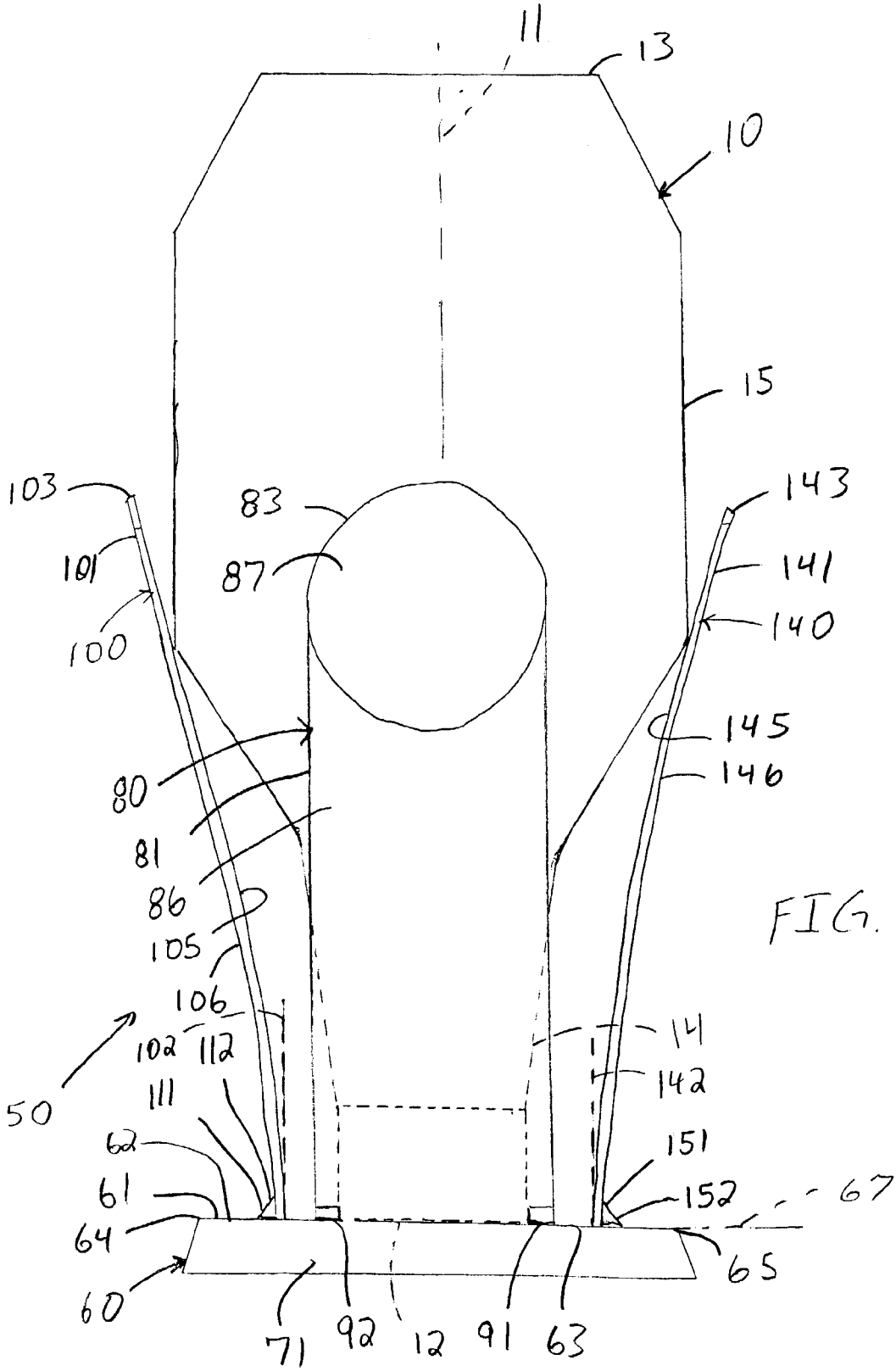
FIG. 2 is a side view of the present invention holding an inverted container of a first size in a vertical orientation.
Figure 3:
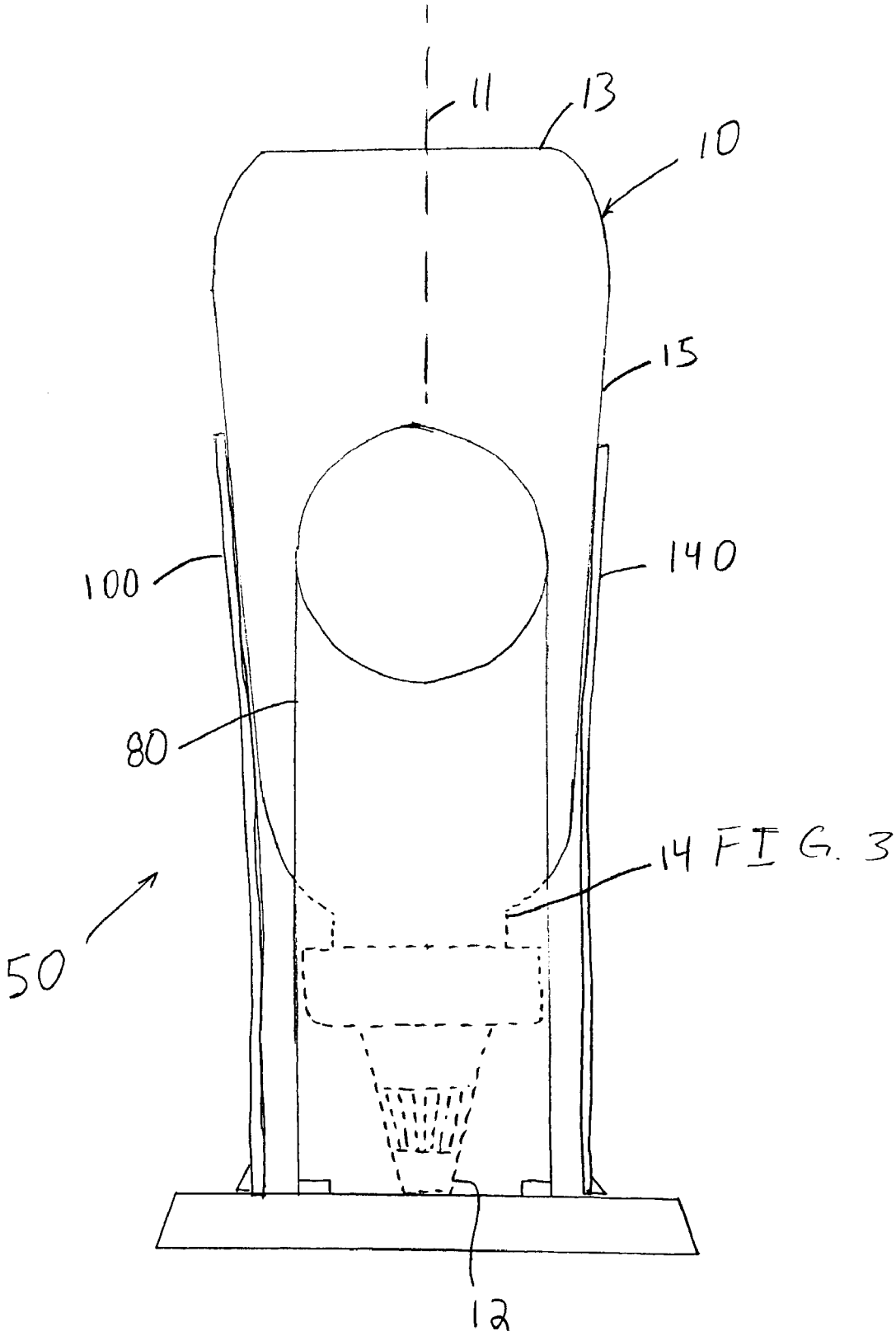
FIG. 3 is a side view of the present invention holding an inverted container of a second size in a vertical orientation.

Turning now to use of the present invention, an inverted container 10 can be received within the present invention 50, as shown in FIGS. 2 and 3. The side members 80, 100, 120 and 140 each deflect varying amounts as necessary throughout their respective upstanding lengths from the base 60 to define a space for receiving the container 10. The side members 80, 100, 120 and 140 can variably deflect out of their respective planes 82, 102, 122 and 142 to engage the body 15 of the inverted container 10. The members 80, 100, 120 and 140 engage the body 15 of the inverted container 10 to keep its central axis 11 generally perpendicular to the platform plane 67.

The side members 80, 100, 120 and 140 preferably deflect from their respective planes 82, 102, 122 and 142 as far as necessary so that the top 12 of the inverted container 10 rests of the surface 62 of the platform. The center of gravity of the inverted container 10 is therefore kept to a minimum. Having a low center of gravity reduces the chance that the present invention will be inadvertently knocked over.

Thus it is apparent that there has been provided, in accordance with the invention, an inverted container holder 50 that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An apparatus for holding an inverted container comprising:

A. a base having a platform defining a first plane, and having a perimeter defining a base area, said platform having a first slot, a second slot, a third slot and a fourth slot formed there through;

B. a first resilient member upstanding from said base at a fixed position and having a first resilient member upstanding length and lying in a second plane that is generally perpendicular to said first plane, said first resilient member being completely within said base area at said base and said first resilient member being deflectable from said second plane throughout said first resilient member upstanding length, said first resilient member further having a first top wedge and a first bottom wedge extending from said second plane, wherein when said first resilient member is inserted through said first slot, said first top wedge and said first bottom wedge engage said platform;

C. a second resilient member upstanding from said base at a fixed position and having a second resilient member upstanding length and lying in a third plane that is generally perpendicular to said first plane and said second plane, said second resilient member being completely within said base area at said base and said second resilient member being deflectable from said third plane throughout said second resilient member upstanding length, said second resilient member further having a second top wedge and a second bottom wedge extending from said third plane, wherein when said second resilient member is inserted through said second slot, said second top wedge and said second bottom wedge engage said platform;

D. a third resilient member upstanding from said base at a fixed position and having a third resilient member upstanding length and lying in a fourth plane that is generally perpendicular to said first plane and parallel to said second plane, said third resilient member being completely within said base area at said base and said third resilient member being deflectable from said fourth plane throughout said third resilient member upstanding length, said third resilient member further having a third top wedge and a third bottom wedge extending from said fourth plane, wherein when said third resilient member is inserted through said third slot said third top wedge and said third bottom wedge engage said platform; and E. a fourth resilient member upstanding from said base at a fixed position and having a fourth resilient member upstanding length and lying in fifth plane that is generally perpendicular to said first plane and parallel to said third plane, said fourth resilient member being completely within said base area at said base and said fourth resilient member being deflectable from said fifth plane throughout said fourth resilient member upstanding length, said fourth resilient member further having a fourth top wedge and a fourth bottom wedge extending from said fifth plane, wherein when said fourth resilient member is inserted through said fourth slot, said fourth top wedge and said fourth bottom wedge engage said platform, wherein said base, said first resilient member, said second resilient member, said third resilient member and said fourth resilient member define a space for receiving an inverted container.

2. The apparatus of claim 1 wherein:

A. said first resilient member comprises a first grip, said first grip generally lying in said second plane when said first resilient member is undeflected; and B. said third resilient member comprises a second grip, said second grip generally lying in said fourth plane when said third resilient member is undeflected.

3. The apparatus of claim 1 wherein said first resilient member, said second resilient member, said third resilient member and said fourth resilient member are generally transparent.

4. A device for holding an inverted container in a vertical orientation comprising a base with a base top and a base bottom, the base having a perimeter defining a base area, the base further having a plurality of slots formed there through, the device further comprising a plurality of generally flat members upstanding from said base, wherein:

A. the number of said plurality of generally flat members corresponds to said plurality of slots;

B. each of said plurality of generally flat members has an upstanding length;

C. said base and said plurality of generally flat members define a space for receiving an inverted container wherein the inverted container is restable on said surface of said base;

D. each of said plurality of generally flat members is resiliently deflectable throughout its respective upstanding length to selectably engage an inverted container received within said space, E. each of said plurality of generally flat members upstands from said base at a fixed location completely within said perimeter of said base area; and F. each of said plurality of generally flat members has a top wedge and a bottom wedge, wherein when each of said plurality of generally flat members is inserted through said respective slot, said respective top wedge and said respective bottom wedge engages said base.

5. The device of claim 4 wherein said plurality of generally flat members comprises four generally flat members.

6. The device of claim 4 wherein said plurality of generally flat members each has a free end, and at least two of said plurality of generally flat members have a grip near said respective free ends, said grips being generally within the same plane as said generally flat members, respectively.

7. The device of claim 4 wherein each of said plurality of generally flat members is removeably insertable into one of said slots.

* * * * *